US005443538A

United States Patent [19]

Little

[11] Patent Number: 5,443,538

[45] Date of Patent: Aug. 22, 1995

[54] METHOD AND APPARATUS FOR DRYING SMALL ARTICLES OF WEARING APPAREL

[76] Inventor: David H. Little, 2107-G Cassia Cir., Kissimmee, Fla. 34741

[21] Appl. No.: 7,882

[22] Filed: Jan. 22, 1993

[51] Int. Cl.[6] ..... F26B 19/00

[52] U.S. Cl. ..... 34/91; 34/618

[58] Field of Search ..... 34/90, 91, 151, 23, 34/243 R, 611, 618, 444

[56] References Cited

U.S. PATENT DOCUMENTS

| | | | |
|---|---|---|---|
| 2,774,148 | 12/1956 | Worth | 34/133 |
| 3,303,577 | 2/1967 | Laing | 34/151 |
| 3,577,650 | 5/1971 | Brahm | 34/151 |
| 4,199,873 | 4/1980 | Hansen | 34/202 |
| 4,406,071 | 9/1983 | Buchanan | 34/91 |
| 4,815,219 | 3/1989 | Binger | 34/22 |
| 4,868,998 | 9/1989 | Rubin | 34/91 |
| 4,918,290 | 4/1990 | DeMars | 219/400 |
| 5,014,446 | 5/1991 | Beesman | 34/151 |
| 5,038,497 | 8/1991 | Pelequin | 34/151 |

*Primary Examiner*—Henry A. Bennet

*Attorney, Agent, or Firm*—Shlesinger Arkwright & Garvey

[57] ABSTRACT

A method and apparatus for drying small articles of wearing apparel wherein the articles of wearing apparel are placed in a drying chamber having a curved surface on which the wearing apparel is placed, applying warm air under pressure along the curved surface to dry and tumble the wearing apparel to expedite the drying thereof.

15 Claims, 3 Drawing Sheets

FIG. 6
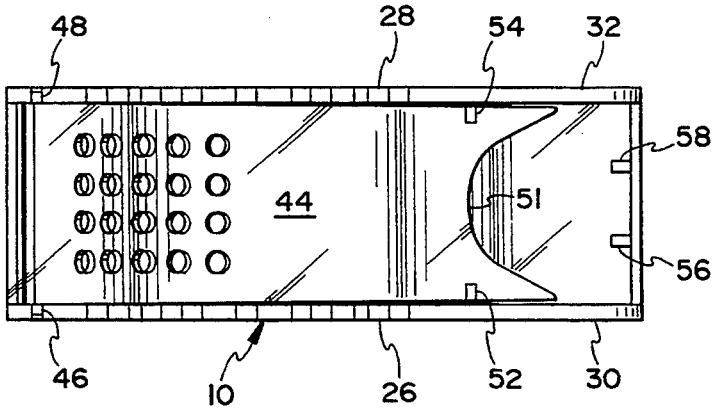
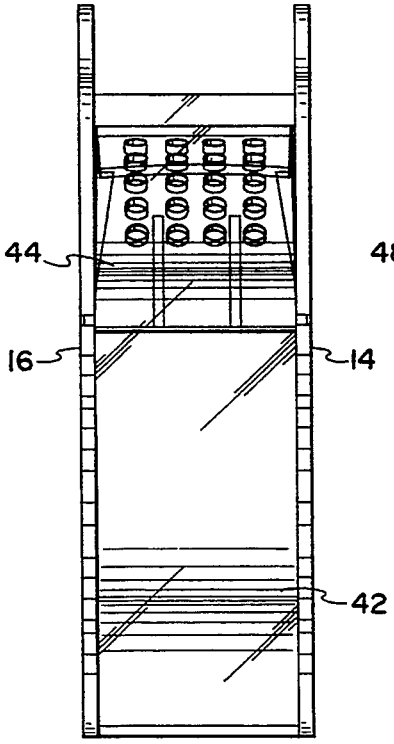
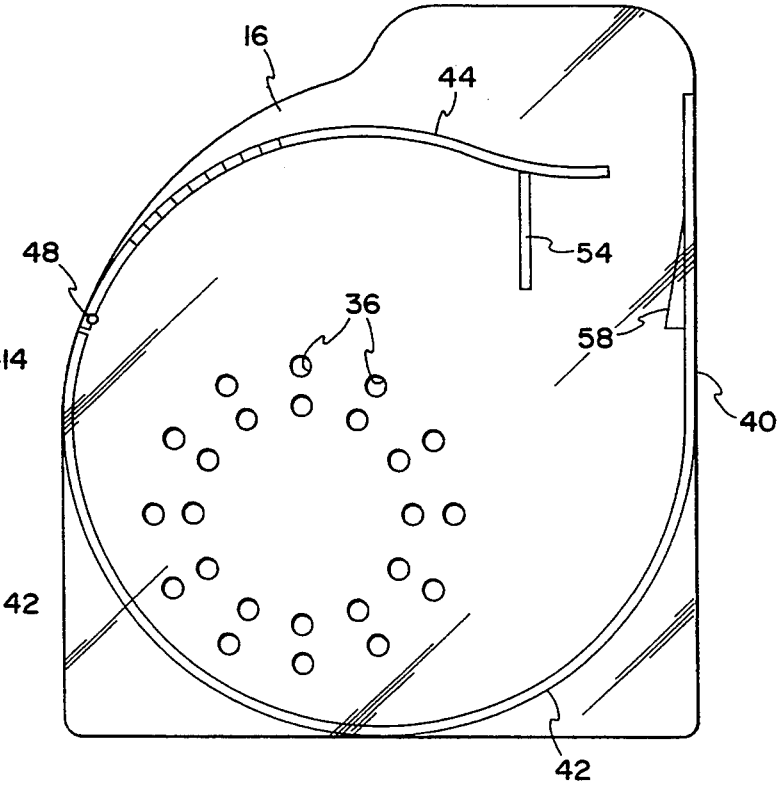
FIG. 5
FIG. 4

METHOD AND APPARATUS FOR DRYING SMALL ARTICLES OF WEARING APPAREL

FIELD OF INVENTION

This invention is a method and apparatus for drying small articles of wearing apparel such as women's pantyhose, underwear, socks, etc., wherein the drying action may be furnished by a conventional hair dryer.

BACKGROUND OF THE INVENTION

It is conventional practice for individuals, whether at home or travelling, to launder a few articles of wearing apparel such as pantyhose, underwear, socks, etc., and then hang them up for drying overnight for use the next day. It frequently happens, however, that, for one reason or another, the articles are not completely dry when needed the next day. In order to solve this problem, various portable dryers have been developed for expediting the drying of the articles of apparel by placing the articles of apparel in a small portable dryer and applying heat thereto with a conventional hair dryer. Illustrative of portable dryers of this type are U.S. No. Pat. 4,199,873 issued Apr. 29, 1980 and U.S. Pat. No. 4,868,998 issued Sep. 26, 1989.

Although these portable dryers will effect drying of the wearing apparel, the apparel lies in a static position within the dryer, and is not subjected to the tumbling action which is produced in a standard sized clothes dryer, where the apparel is tumbled in a rotating drum while being heated. Consequently, it takes longer to dry the apparel, and the articles of apparel do not have the appearance or feel of articles which are tumbled in a conventional sized dryer.

U.S. Pat. No. 4,868,998 issued Sep. 26, 1989 does disclose a small tumbler dryer, powered by a hair dryer, wherein a wall mounted unit is provided having a drum in which the apparel is placed, a drum having turbine blades which are rotated by the heated air from the dryer. Vents are also provided in the drum for admitting the air into the drum for drying the articles.

SUMMARY OF THE INVENTION

The present invention is a method and apparatus for drying small articles of wearing apparel which are placed in a drum-shaped drying chamber having a curved surface on which the apparel is placed. Warm air under pressure is introduced into the chamber, the air being directed along the curved surface, producing a lifting or tumbling action on the wearing apparel which produces rapid and uniform drying of the wearing apparel.

The portable dryer includes a housing having a stationary drum-shaped drying chamber having a door hingedly engaged with the upper end thereof in order to add and remove articles of wearing apparel therefrom. An inlet opening is located near the upper end of the chamber into which the nozzle of a hair dryer may be inserted for directing warm air under pressure into the drying chamber along the curved surface of the drum-shaped drying chamber. The warm air moving along the curved surface of the drying chamber contacts the articles of wearing apparel which are in engagement with the curved surface for drying the articles of apparel.

The air under pressure effects a lifting and tumbling action of the articles of apparel to be moved in a circular, tumbling motion which effects uniform and complete drying thereof.

DESCRIPTION OF FIGURES OF THE DRAWING

FIG. 4 is a side elevational view of the portable dryer of the present invention;

FIG. 5 is a front elevational view thereof; and

FIG. 6 is a top plan view thereof.

DETAILED DESCRIPTION OF THE INVENTION

Figure 1:
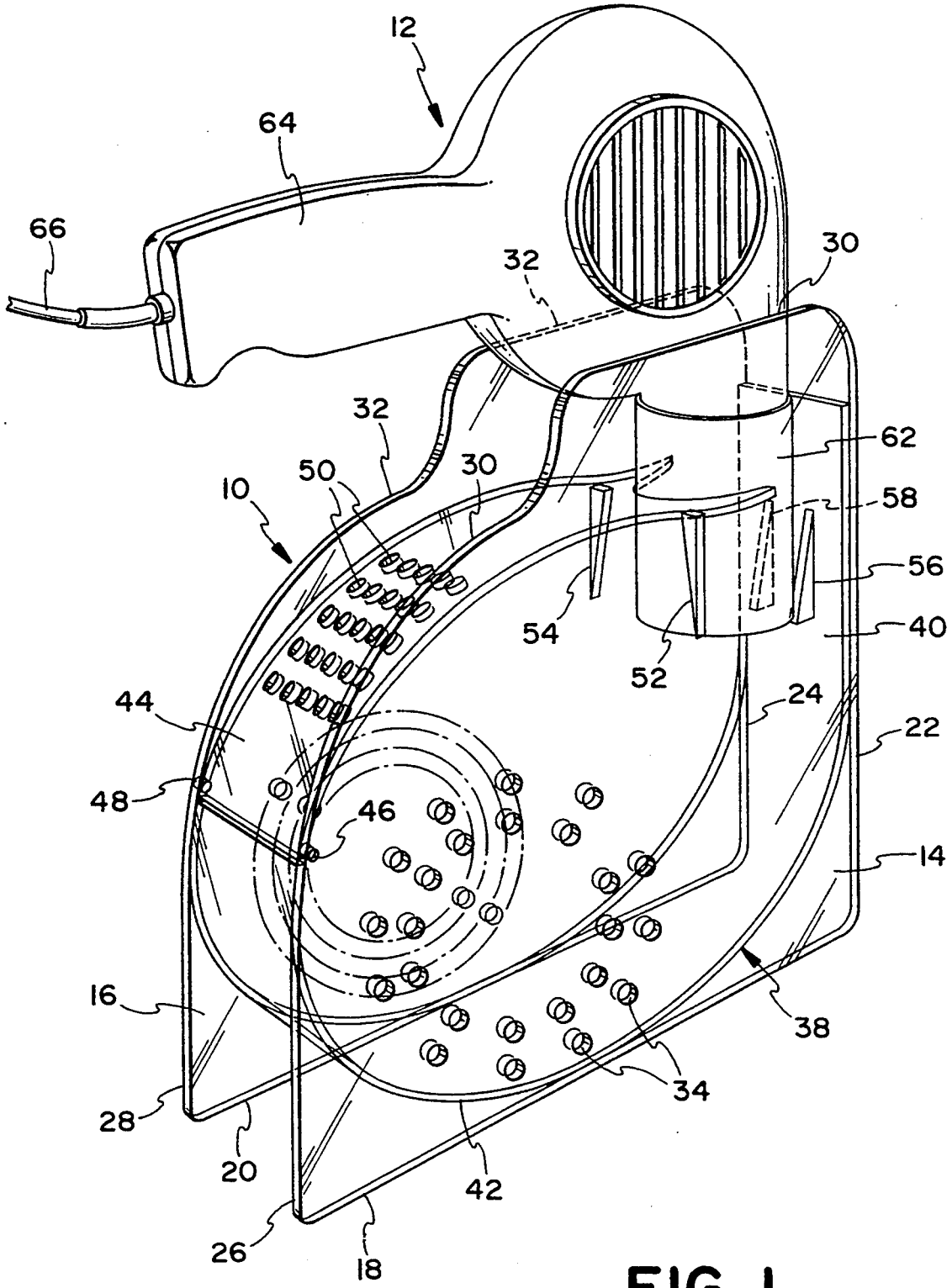
FIG. 1 is a perspective view of the present invention with a conventional hair dryer positioned therein.
Figure 2:
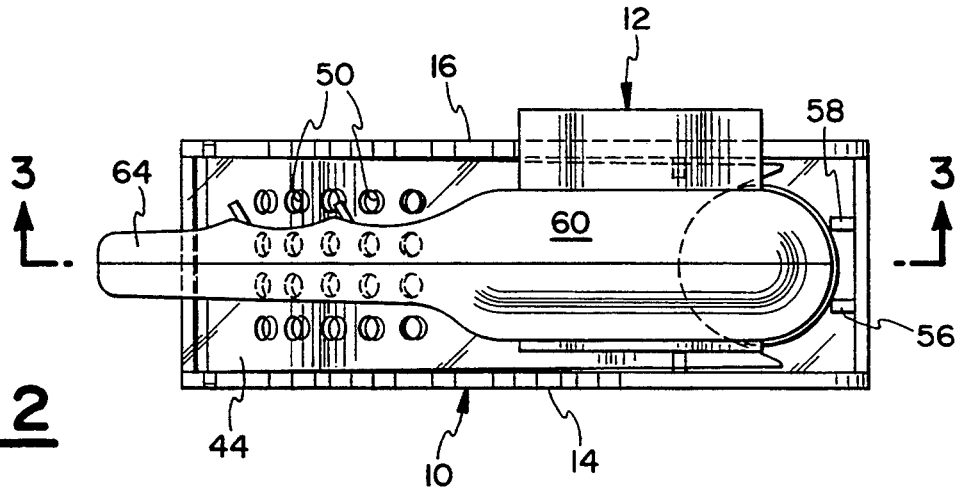
FIG. 2 is a top plan view thereof.

The portable dryer of the present invention includes a housing generally designated 10 which is adapted for attachment to a conventional hand held hair dryer 12.

Housing 10 comprises a pair of like, spaced sidewalls 14 and having rectilinear bottom edges 18 and 20 forming a base or support, and rectilinear rear edges 22 and 24. Sidewalls 14 and 16 are further provided with rectilinear front edges 26 and 28 which issue into curved top edges 30 and 32. Sidewalls 14 and 16 are further provided with a plurality of air holes 34 and 36 for reasons which will be hereinafter more fully set out.

A connecting wall generally designated 38 extends between sidewalls 14 and 16, said connecting wall including a straight portion 40 which extends from a point near the top of sidewall edges 22 and 24 to a point intermediate the length thereof, at which point it is curved to provide a curved section 42 which extends downwardly between bottom edges 18 and 20 and then upwardly to a point intermediate the height of front edge 28.

A curved combination door and wall 44 extends between sidewalls 14 and 16, and is hingedly engaged with curved portion 42 of wall 38, as indicated at 46 and 48. Air holes are provided in combination wall and lid 44 as indicated at 50. The end of combination wall and lid 44 is provided with an arcuate cutout 51 and a plurality of adjustment ribs are affixed to the inner walls of sidewalls 14 and 16, as indicated at 52 and 54 and to straight portion 40 of wall 38 as indicated at 56 and 58.

Hair dryer 12 includes a blower housing 60 having a nozzle 62 at one end and a handle 64 connected by an electric cord 66 to an electrical outlet.

Figure 3:
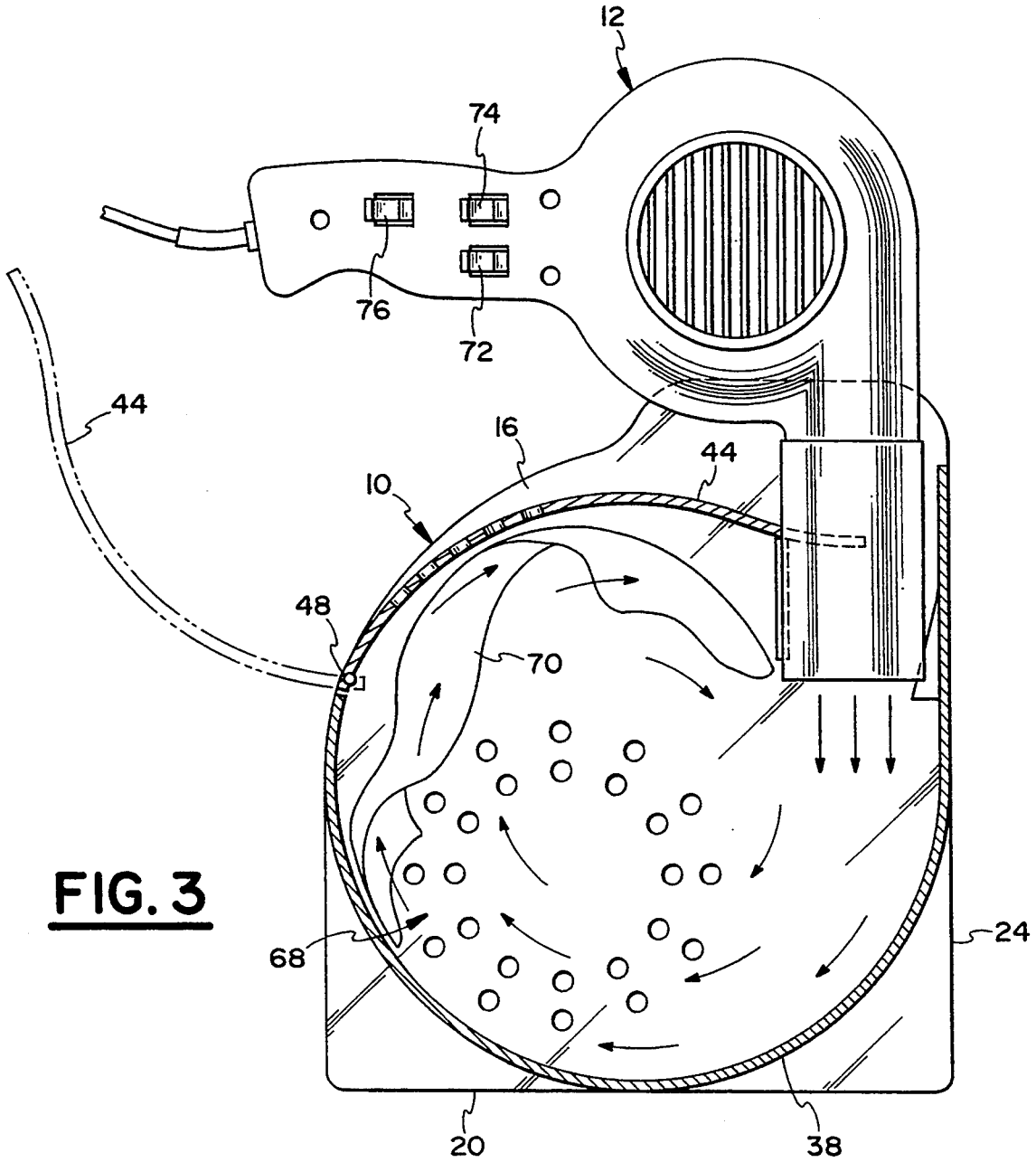
FIG. 3 is a sectional view taken along the line 3—3 of FIG. 2, looking in the direction of the arrows.

It will be noted from a consideration of FIGS. 3 and 4 of the drawing that the walls of the housing form a drying chamber 68 of drum shape for receiving an article or articles of wearing apparel 70. This shape further facilitates the tumbling action of articles of apparel 70 under the force of heated air provided by hair dryer 12. It will be further noted that the drum shape of drying chamber 68 defines a curved rigid member which maintains its shape when subjected to circulating drying air, as will be appreciated from considering FIGS. 3 and 4, and the use of the invention further described under OPERATION, for example.

OPERATION

In use of the apparatus of the present invention, the garments 70 to be dried are placed within drying chamber 68 by opening the combination door and wall 44, as illustrated in dotted lines in FIG. 3. The apparel 70 gravitates to the bottom of the air chamber where it engages the curved portion 42 of wall 38. Hair dryer 12 is next engaged with the dryer by inserting nozzle 62 through the opening formed by arcuate cutout 51 of combination wall, door 44 and straight portion 40 of wall 38. Triangular shaped ribs 52, 54, 56 and 58 serve to position dryer 12 so that the warm air which passes through nozzle 62 will be directed downwardly along straight wall portion 40 and will follow the curved contour of curved portion 42 of wall 38.

Hair dryer 12 is then actuated by means of conventional switches 72, 74 and 76 to direct warm air downwardly so that it follows the contour of the drum shaped air chamber as shown by arrows in FIG. 3.

As the air moves into contact with the articles of apparel 70, it will dry the articles and, after drying has been initiated, will lift and tumble the articles in a manner similar to the tumbling action of a standard sized clothes dryer. As the air moves upwardly of the drying chamber, most of it will pass through vent holes 50 in combination door and wall 44. Sidewall openings 34 and 36 also permit air to be vented from the air chamber, and also prevent back pressure from occurring within the chamber.

By virtue of the tumbling motion of the articles of apparel, they are rapidly and uniformly dried, usually in a period of several minutes, following which they may be removed from the drying chamber.

The present method and apparatus have been particularly useful in drying pantyhose which can be dried in approximately three minutes. Also, during the drying and tumbling operation, the pantyhose shrinks to its original size thereby substantially prolonging the life thereof.

Although the portable dryer of the present invention may be made of any suitable material, it has been found that optimum results are obtained with polypropylene or nucleated polypropylene which is injection molded to form the component parts of the portable dryer, and wherein the dryer walls are translucent in order to permit observation of the articles of apparel while going through the drying cycle.

The method and apparatus of the present invention affords simple and economic means for drying small articles of wearing apparel with a portable dryer which of small, lightweight construction.

Although the apparatus of the present invention has been described for use with a hair dryer which may be detachably engaged with the dryer during the drying operation, it is to be understood that a source of heated air under pressure may be permanently connected to the dryer for supplying heated air to the unit.

While there has been herein shown and described the presently preferred form of this invention, it is to be understood that such has been done for purposes of illustration only, and that various changes may be made therein within the scope of the appended claims.

I claim:

1. A method for drying small articles of wearing apparel comprising the steps of:

a) placing articles of wearing apparel on the rigid curved surface of a stationary drying chamber, said rigid curved surface maintaining its shape when subjected to circulating drying air; and b) tumbling and drying articles of wearing apparel placed on the rigid curved surface by forcing air under pressure along the rigid curved surface, the articles of apparel being tumbled by application of air under pressure, to expedite the drying thereof.

2. The drying method of claim 1, wherein:

a) the drying chamber is of substantially drum shape.

3. Apparatus for drying small articles of wearing apparel, comprising:

a) a housing;

b) a stationary drying chamber within said housing in which small articles of wearing apparel are placed for drying;

c) a first means in said housing for admitting air under pressure;

d) a second means for tumbling the articles of wearing apparel in the stationary drying chamber when contacted by pressurized air admitted by said first means to effect rapid drying thereof; and, e) said second means including a rigid, curved surface configured for maintaining its shape when contacted by the pressurized air.

4. The apparatus of claim 3, wherein:

a) said drawing chamber is of drum shape and includes spaced side walls and a curved peripheral wall, said curved peripheral wall being configured for tumbling articles of wearing apparel placed on said curved peripheral wall when contacted by pressurized air.

5. The apparatus of claim 4, wherein:

a) said first means comprises an inlet in said drum shaped drying chamber; and b) said second means includes the alignment of said inlet opening with the curved wall of said drying chamber, whereby air under pressure is directed along the curved wall to effect lifting and tumbling of articles of wearing apparel for drying the latter.

6. The apparatus of claim 5, with the addition of:

a) access means in said housing for placing the articles of wearing apparel in said drying chamber.

7. The apparatus of claim 6 wherein:

a) said access means is a door engaged with said curved peripheral wall.

8. The apparatus of claim 7, wherein:

a) said door is curved, and b) said door being provided with a plurality of air vents.

9. The apparatus of claim 8, wherein:

a) said side walls are provided with a plurality of air vents.

10. Apparatus for drying small articles of wearing apparel, for use with a conventional hand held hair dryer having a nozzle for exhausting pressurized air, said apparatus comprising:

a) a housing including spaced opposed side walls and a connector wall between said side walls, at least a portion of which is rigid and curved, said at least a portion maintaining its shape when subjected to pressurized air from a hair dryer, thereby forming a stationary drying chamber into which the articles of wearing apparel are placed;

b) said connector wall having an inlet opening adapted to receive the nozzle of a hair dryer;

c) said inlet opening being aligned with the curved portion of said connector wall to effect movement of pressurized air from a hair dryer along the rigid curved portion of said wall into drying contact with the articles of wearing apparel, which are tumbled by continued application of air under pressure to expedite the drying thereof.

11. The apparatus of claim 10, with the addition of:

a) an access door engaged with said connector wall, for adding articles of wearing apparel to and removing them from, the drying chamber.

12. The apparatus of claim 11, with the addition of:

a) air vents in said access door.

13. The apparatus of claim 12, with the addition of:

a) air vents in said side walls.

14. The apparatus of claim 10, with the addition of:

a) air vents in said side walls.

15. The apparatus of claim 10, with the addition of:

a) air vents in said connector wall.

* * * * *